US005291557A

United States Patent [19]

Davis et al.

[11] Patent Number: 5,291,557

[45] Date of Patent: Mar. 1, 1994

[54] ADAPTIVE REMATRIXING OF MATRIXED AUDIO SIGNALS

[75] Inventors: Mark F. Davis, Pacifica; Stephen D. Vernon, Palo Alto, both of Calif.

[73] Assignee: Dolby Laboratories Licensing Corporation, San Francisco, Calif.

[21] Appl. No.: 959,730

[22] Filed: Oct. 13, 1992

[51] Int. Cl.[5] ..... H04S 3/02

[52] U.S. Cl. ..... 381/22; 381/23

[58] Field of Search ..... 381/22, 23, 18, 20, 381/21

[56] References Cited

U.S. PATENT DOCUMENTS 3,944,735 3/1976 Willcocks ..... 381/20
4,799,260 1/1989 Mandell et al. .
5,109,417 4/1992 Fielder et al. .

OTHER PUBLICATIONS

Davidson, Grant, Antill, Fielder, Louis, Antill, Mike; "High-Quality Audio Transform Coding at 128 kBits/s," Dolby Technical Papers Publication No. S90/8873, reprinted from *Proceedings of International Acoustics, Speech, and Signal Processing*, Albuquerque, N.M., Apr. 1990.

International Organization for Standardization, "Coding of Moving Pictures and Associated Audio," ISO-/IECF JTC1/SC2/WG11, MPEG 90/000, Berlin Meeting Documents, Dec. 1990, Appendix pp. 100, 101, and two unumbered pages labeled General Stereo Encoder Flow-Chart, and General Stereo Decoder Flow-Chart.

van der Waal, Robbert G. et al, "Subband Coding of Stereophonic Digital Audio Signals," 1991 International Conference on Acoustics, Speech, and Signal Processing, vol. 5, May 14-17, 1991, Toronto, Ontario, Canada pp. 3601-3604.

ten Kate, W. R. Th. et al, "Matrixing of Bit Rate Reduced Audio Signals," *Proc. ICASSP-92*, vol. 2, pp. II-205-208, IEEE, San Francisco, Mar. 23-26, 1992.

Theiler, Günther et al, "MUSICAM-Surround: A Multi-Channel Stereo Coding Method," Audio Engineering Society Preprint 3337, Presented at 92nd Convention, 1992 Mar. 24-27, Vienna, Austria.

ten Kate, W. R. Th. et al, "A New Surround-Stereo-Surround Coding Technique," *J. Audio Eng. Soc.*, vol. 40, No. 5, May 1992, pp. 376-383 (German version appeared in *RTM*, vol. 35, pp. 10-16 (1991)).

International Organization for Standardization, "Coding of Moving Pictures and Associated Audio for Digital Storage Media at up to about 1.5 Mbits/s," Document CD 11172-3, Part 3, Audio, Annex G, Joint Stereo Coding, subpart 3-G.2 ms_Stereo and Intensity Stereo Coding Layer III Sep. 1992, pp. G-1 and G-2.

*Primary Examiner*—Forester W. Isen
*Assistant Examiner*—Mark D. Kelly
*Attorney, Agent, or Firm*—Thomas A. Gallagher

[57] ABSTRACT

In a system in which a low-bit rate encoder and decoder carries matrixed audio signals, an adaptive rematrix rematrixes matrixed signals from an unmodified 4:2 matrix encoder to separate and isolate quiet components from loud ones, thereby avoiding the corruption of quiet signals with the low-bit-rate coding quantization noise of loud signals. The decoder is similarly equipped with a rematrix, which tracks the encoder rematrix and restores the signals to the form required by the unmodified 2:4 matrix decoder. The encoder adaptive rematrix selects the matrix output signals or the amplitude weighted sum and difference of the matrix output signals. The choice of whether the matrix output signals or the sum and difference of the matrix output signals are selected is based on a determination of which results in fewer undesirable artifacts when the output audio signals are recovered in the decoder. The adaptive rematrix may operate on frequency component representations of signals rather than the time-domain signals themselves.

47 Claims, 3 Drawing Sheets

ADAPTIVE REMATRIXING OF MATRIXED AUDIO SIGNALS

DESCRIPTION

1. Technical Field

The invention relates to audio signal processing, and more particularly to adaptively modifying matrixed audio signals, or their frequency component representations, in an environment in which the noise level varies with signal amplitude.

2. Background of the Invention

Audio matrix encoding and decoding is widely used for the soundtracks of motion picture and video recordings in order to carry 4 channels of sound on a two-track or two-channel medium. The most commonly used system employs the "MP" matrix, a 4:2:4 matrix system that records four source channels of sound on two record media channels and reproduces four channels. Commercial systems employing the MP matrix are known under the trademarks Dolby Stereo and Dolby Surround.

The MP 4:2 encode matrix is defined by the following relationships:

$$L_T = L + 0.707C + 0.707S \quad \text{(Eqn. 1)}$$

$$R_T = R + 0.707C - 0.707S \quad \text{(Eqn. 2)}$$

where L is the Left channel signal, R is the Right channel signal, C is the Center channel signal and S is the Surround channel signal. Thus, the matrix encoder output signals are weighted sums of the four source signals. $L_T$ and $R_T$ are the matrix output signals.

The MP 2:4 decode matrix is defined by the following relationships:

$$L' = L_T \quad \text{(Eqn. 3)}$$

$$R' = R_T \quad \text{(Eqn. 4)}$$

$$C' = (L_T + R_T)/\sqrt{2} \quad \text{(Eqn. 5)}$$

$$S' = (L_T - R_T)/\sqrt{2} \quad \text{(Eqn. 6)}$$

where L' represents the decoded Left channel signal, R' represents the decoded Right channel signal, C' represents the decoded Center channel signal and S' represents the decoded Surround channel signal. Thus, the matrix decoder forms its output signals from weighted sums of the 4:2 encoder matrix output signals $L_T$ and $R_T$.

Due to the known shortcomings of a 4:2:4 matrix arrangement, the output signals L', C', R' and S' from the decoding matrix are not exactly the same as the corresponding four input signals to the encoding matrix. This is readily demonstrated by substituting the weighted values of L, C, R and S from Equations 1 and 2 into Equations 3 through 6:

$$L' = L_T = L + 0.707(C + S) \quad \text{(Eqn. 3a)}$$

$$R' = R_T = R + 0.707(C - S) \quad \text{(Eqn. 4a)}$$

$$C' = (L_T + R_T)/\sqrt{2} = C + 0.707(L + R) \quad \text{(Eqn. 5a)}$$

-continued $$S' = (L_T - R_T)/\sqrt{2} = S + 0.707(L - R) \quad \text{(Eqn. 6a)}$$

The crosstalk components (0.707 (C+S) in the L' signal, etc.) are not desired but are a limitation of the basic 4:2:4 matrix technique.

Various approaches are known for improving the performance of a 2:4 decoder matrix. One example is set forth in U.S. Pat. No. 4,799,260, which is hereby incorporated herein by reference in its entirety. Such known decoder enhancement techniques are directed to improving the channel separation and reducing the crosstalk among channels in the decoded signals. The present invention is not directed to such problems but is compatible with them. Thus, if desired, the 2:4 matrix decoder of the present invention, described below, may incorporate 2:4 matrix decoder enhancement as described in the '260 patent or other matrix decoder enhancement techniques. The invention will be described with simple 4:2:4 matrix equations.

Other 4:2:4 audio matrix systems are known in addition to the MP matrix, including the "QS" and "SQ" systems which were the basis of two competing quadraphonic sound systems introduced in the 1970's. The invention is not limited to use with the MP matrix.

Historically, 4:2:4 audio matrix encoding and decoding has been used mainly in connection with two-channel, two-track or stereophonic analog recording media such as vinyl phonograph discs, the optical soundtracks of motion picture film (i.e., "stereo variable area" or SVA optical soundtracks), and the audio tracks of videotape recordings and videodiscs.

More recently, 4:2:4 audio matrix encoding and decoding has also been used in connection with two-channel digital recording media such as Compact Disks and the digital audio tracks of videotape recordings and videodiscs.

In the analog and digital systems just mentioned, uncorrelated channel noise related to signal amplitude in the channel is either not produced or is so small as generally to be trivial. However, in certain types of digital audio systems, such as psychoacoustically-based low-bit-rate transform and subband coders, uncorrelated noise resulting from the low-bit-rate coding quantization is generated which increases with the signal amplitude in the channel. However, listeners generally do not perceive the noise because it is masked by louder desired signal components in the channel. The noise is uncorrelated across or between the channels of the encoder.

When matrixed encoded signals are applied to a low-bit-rate encoder/decoder system and then de-matrixed, the dematrixing, under certain signal conditions, separates the masking signal from the noise in a particular channel, thus potentially making the noise audible in that channel. This is also a problem in other systems which produce uncorrelated noise related to signal amplitude in the channel and the noise is uncorrelated across or between the channels.

As one example of this problem, assume that a 100 dB SPL (sound pressure level) signal is applied to the Center input channel of an MP matrix encoder with no signals (0 dB SPL) applied to the Left, Right or Surround inputs. In accordance with Equations 1 and 2, the encoder applies this signal equally to its $L_T$ and $R_T$ outputs, attenuated 3 dB, resulting in $L_T$ and $R_T$ signals at an equivalent level of 97 dB SPL. Assume further that a low-bit-rate encoder processing these signals has an instantaneous signal-to-noise ratio (SNR) of 30 dB. The 97 dB $L_T$ and $R_T$ correlated signals will each acquire 97−30=67 dB of uncorrelated noise. This uncorrelated noise will be masked in each of the MP matrix decoded Left, Center and Right channels by the respective 97 dB signals. However, when the MP matrix decoder reconstructs the Surround channel by subtracting $R_T$ from $L_T$, the 97 dB correlated signal components cancel but the 67 dB noise components add because they are uncorrelated, resulting in 67 dB SPL of noise in the Surround channel with no signal to mask the noise.

This problem is most noticeable when a channel, such as the Surround channel in this example, is listened to in isolation. However, it is still noticeable under some signal conditions under normal listening conditions when there is some masking from signals in other channels which are reproduced by other loudspeakers. Although the problem has been illustrated with one particular example of signal conditions, it will be apparent to those of ordinary skill in the art that unmasked noise problems will arise under other signal conditions.

Because of the very large number of sound sources, particularly motion pictures, having two MP matrix encoded tracks, on the one hand, and the growing use of low-bit-rate coding systems, on the other hand, there is a pressing need to solve the unmasked noise problem just described because it is likely that two-channel MP matrix encoded sound sources will be stored by or transmitted by low-bit-rate coding systems. The solution to this problem must take into account the need to maintain compatibility with the large population of existing MP matrix encoded sound sources and MP matrix decoding hardware.

Although the invention will be described in connection with the MP matrix, it will be apparent to those of ordinary skill in the art that the principles of the invention are also applicable to other 4:2:4 audio matrix systems. In addition, although the invention will be described in connection with low-bit-rate coding systems in which audio signals in the encoder are divided into frequency components, it will be apparent to those of ordinary skill in the art that the principles of the invention are also applicable to other environments in which the uncorrelated noise related to signal amplitude is produced in a channel and the noise is uncorrelated across or between channels.

SUMMARY OF THE INVENTION

In accordance with the present invention, method and apparatus for solving the unmasked noise problem are provided. The solution maintains compatibility with existing matrix encoded software and matrix hardware. In accordance with the present invention the matrix is adaptively modified as may be necessary by a further matrix in accordance with dynamic signal conditions in order to reduce the unmasked noise problem. Preferably, this is accomplished by means of an adaptive rematrixing apparatus or function separate from the encode and decode matrix. However, under some circumstances, such as a dedicated encoder or decoder, the matrix may be combined physically or functionally with the adaptive rematrixing. Such combination may result in either of two equivalent relationships: a single variable matrix or a fixed matrix associated with a variable matrix. The adaptive rematrixing apparatus or function may operate in the time domain or the frequency domain.

In a preferred embodiment the adaptive rematrixing is performed as an integral function of a low-bit-rate encoder and decoder, a 4:2 encoding matrix providing the two input channels to the encoder and a 2:4 decoding matrix receiving the two output channels from the decoder.

The adaptive rematrix according to the invention rematrixes the incoming matrixed signals from the unmodified 4:2 matrix encoder to isolate quiet components from loud ones, thereby avoiding the corruption of quiet signals with the low-bit-rate coding quantization noise of loud signals. The decoder is similarly equipped with a rematrix, which tracks the encoder rematrix and restores the signals to the form required by the unmodified 2:4 matrix decoder. As mentioned above, the 2:4 matrix decoder may employ separation enhancement techniques, but the use or nonuse of such techniques is unrelated to the present invention.

In its broadest aspects, the encoder adaptive rematrix according to the invention comprises means for selectively applying the matrix output signals or the sum and difference of the matrix output signals to the coding, transmission, or storage and retrieval.

The choice of whether the matrix output signals or the sum and difference of the matrix output signals are selected is based on a determination of which results in fewer undesirable artifacts when the output audio signals are recovered in the decoder. The inventors have determined that this effect is substantially achieved by determining which of the signals among the matrix output signals and the sum and difference of the matrix output signals has the smallest amplitude, and applying the matrix output signals to the coding, transmission or storage if one of the matrix output signals has the smallest amplitude and for applying the sum and difference of the matrix output signals to the coding, transmission or storage if one of the sum and difference of the matrix output signals has the smallest amplitude. The sum and difference signals may be amplitude weighted. The adaptive rematrix may operate on frequency component representations of signals rather than the time-domain signals themselves. The amplitude determination may be made with respect to frequency weighted signals—for example, mid-range frequencies may be weighted more heavily.

The terminology "frequency component representations" is used in this document to refer to the output of an analog filter bank, the output of a digital filter bank or a quadrature mirror filter, such as in digital subband coders, and to the transform coefficients generated in digital transform coders.

In its broadest aspects, the decoder adaptive rematrix according to the invention includes means for recovering the received signals unaltered when the encoder adaptive matrix applied the matrix output signals to the coding, transmission or storage and for recovering the sum and difference when the encoder applied the sum and difference of the matrix output signals to the coding, transmission or storage. The sum and difference signals may be amplitude weighted.

The encode adaptive rematrix takes one of two forms or states: an identity, no change matrix and a sum/difference matrix. The choice of the identity matrix or the alternate sum/difference matrix is accomplished dynamically by determining which of the signals among the encode matrix output signals and the sum and difference of the encode matrix output signals has the smallest amplitude, preferably RMS amplitude, and applying the matrix output signals to the coding, transmission or storage if one of the matrix output signals has the smallest amplitude and applying the sum and difference of the matrix output signals to the coding, transmission or storage if one of the sum and difference of the matrix output signals has the smallest amplitude. A control signal, which can be one bit of side information, is used to signal the decoder which state of the rematrix is in use. If necessary, a time constant or hysteresis function may be included so that small changes in relative amplitudes over some period of time do not cause a change in state of the adaptive rematrix.

In the preferred embodiment, the identity matrix form of the encode adaptive matrix applies $L_T$ and $R_T$ as shown in Equations 1 and 2, while the alternate sum/-difference matrix form of the encode adaptive matrix applies a weighted sum $L_T' = \frac{1}{2}(L_T + R_T)$ in lieu of $L_T$ and a weighted difference $R_T' = \frac{1}{2}(L_T - R_T)$ in lieu of $R_T$. The controller portion of the encode adaptive matrix selects either the identity matrix or the alternate matrix based on the amplitudes of $L_T$, $R_T$, $L_T'$ and $R_T'$.

The combined action of a 4:2 MP encode matrix and the adaptive rematrix thus provides either the standard MP matrix encoder outputs $L_T$ and $R_T$ as given by Equations 1 and 2 or alternate outputs $L_T'$ and $R_T'$ given by the relationships:

$$L_T' = \tfrac{1}{2}(L_T + R_T) = \tfrac{1}{2}(L + R) + 0.707C \quad \text{(Eqn. 7)}$$

$$R_T' = \tfrac{1}{2}(L_T - R_T) = \tfrac{1}{2}(L - R) + 0.707S \quad \text{(Eqn. 8)}$$

where L is the Left channel signal, R is the Right channel signal, C is the Center channel signal and S is the Surround channel signal. The alternate encode matrix output given by Equations 7 and 8 is a 90 degree rotation of the standard MP encode matrix given by Equations 1 and 2 so as to isolate the C and S signal components rather than the L and R signal components.

The 0.5 weighting shown in Equations 7 and 8 may be varied so long as the combined effect of the encode adaptive rematrix and the decode adaptive rematrix is substantially that of an identity matrix. Thus, equations 7 and 8 may be expressed more generally as:

$$L_T' = k_1(L_T + R_T) = k_1(L + R + \sqrt{2}\,C) \quad \text{(Eqn. 7a)}$$

$$R_T' = k_1(L_T - R_T) = k_1(L - R + \sqrt{2}\,S), \quad \text{(Eqn. 8a)}$$

where "$k_1$" is a constant subject to the aforementioned constraints.

The adaptive rematrix in the decoding arrangement also takes one of two forms or states: an identity, no change matrix and a sum/difference matrix. The choice of the identity matrix or the alternate sum/difference matrix is controlled by a control signal or control bit received from the encoder which indicates the state of the adaptive rematrix in the encoder. The decoder adaptive rematrix reconstructs the two channels as they were prior to adaptive rematrixing in the encoding arrangement subject to system degradation and degradation in the transmission and storage and retrieval. If the alternate matrix bit is set, it recovers one input as the sum of the received signals and the other input as the difference of the received signals, otherwise it provides its input as its output. Thus, the decode adaptive rematrix also has two states and they track the state of the encode adaptive rematrix. Therefore, the output of the decode adaptive rematrix is the same as if no adaptive rematrixing had been used in the encoding arrangement.

The adaptive rematrix in the encoder and the adaptive rematrix in the decoder function essentially in the same way at the same time. They differ from each other only in the amplitude weighting or scaling applied to their respective output signals and in that the encoder adaptive rematrix has a controller. Because they operate together as part of a system, the way in which the amplitude weighting or scaling is apportioned between the encode rematrix and the decode rematrix is arbitrary so long as the output of the decode rematrix remains substantially unchanged as the encode and decode rematrix track with each other in switching between their two states. The combination of the encode rematrix and the decode rematrix is an identity matrix for both modes of operation. Thus, although in the preferred embodiment disclosed the encode and decode rematrices have amplitude scalings of 0.5 and 1.0, these weightings may be varied so long as the combination of the encode and decode rematrix remains substantially an identity matrix. It should be noted that the $L_T'$ and $R_T'$ values applied to the four-way controller in the encode rematrix should incorporate the amplitude scaling employed in the encode rematrix.

Taken in isolation, the combined action of the decode adaptive rematrix and the standard 2:4 MP matrix decoder provide either the standard MP matrix decoder output as given by Equations 3 though 6 (but replacing "$L_T$" with "$(L_T)_D$" and "$R_T$" with $(R_T)_D$ in each instance in order to indicate that the terms are decoded representations of the signals) or an alternate output given by the relationships:

$$L' = (L_T')_D + (R_T')_D \quad \text{(Eqn. 9)}$$

$$R' = (L_T')_D - (R_T')_D \quad \text{(Eqn. 10)}$$

$$C' = (L_T')_D\sqrt{2} \quad \text{(Eqn. 11)}$$

$$S' = (R_T')_D\sqrt{2} \quad \text{(Eqn. 12)}$$

where $(L_T')_D$ and $(R_T')_D$ are the two alternate outputs resulting from the combination of 4:2 MP encode matrix and the encode adaptive rematrix defined by Equations 7 and 8. The subscript D indicates that these are the decoded values of $L_T'$ and $R_T'$. Under these conditions, the outputs of the adaptive rematrix 26 are $(L_T')_D + (R_T')_D$ and $(L_T')_D - (R_T')_D$, respectively. The alternate decode matrix output given by Equations 9 through 12 is a 90 degree rotation of the standard MP decode matrix output given by Equations 3 through 6.

The 1.0 weighting of the alternate adaptive rematrix output may be varied so long as the combined effect of the encode adaptive rematrix and the decode adaptive rematrix is substantially that of an identity matrix. Thus, the outputs of the adaptive rematrix in its alternate sum/difference form may be expressed more generally as $k_2[(L_T')_D + (R_T')_D]$ and $k_2[(L_T')_D - (R_T')_D]$, respectively, where "$k_2$" is a constant subject to the aforementioned constraints.

If the weighted values of L, R, C and S corresponding to $L_T'$ and $R_T'$ in Equations 7 and 8 are substituted for $(L_T')_D$ and $(R_T')_D$ in equations 9 through 12, the output of the 2:4 MP matrix decoder is the same as in equations 3 through 6. Thus, under both modes of operation the 2:4 matrix decoder desired signal components remains the same, however, undesired noise components are reduced in the manner of the example set forth below.

When the invention is used in connection with a low-bit-rate encoder in which audio signals are divided into frequency components and the frequency components are subject to bit-rate reduction encoding, the adaptive rematrix preferably forms a part of the low-bit-rate encoder and operates on the incoming signals from the 4:2 matrix encoder after those signals have been divided into frequency components and prior to their bit rate reduction encoding. In the decoder, the adaptive rematrix preferably forms a part of the decoder and operates on frequency components prior to the assembly of the frequency components into time-domain signals.

In the preferred embodiment, the low-bit-rate encoder and decoder are of the type described in U.S. Pat. No. 5,109,417, which is hereby incorporated herein by reference in its entirety, and in the published international patent application WO 92/12607, published Jul. 23, 1992 entitled "Encoder/Decoder for Multidimensional Sound Fields. The encoder/decoder system of the '417 patent uses a transform to divide the time-domain audio signals into frequency components. Prior to the transformation, the input audio signals are divided into time blocks and the transform then acts on each block. In such a system, the adaptive rematrix decision is done on a block-by-block basis such that the rematrix assumes either its identity or alternate configuration for each block.

In explaining the problem addressed by the invention, a specific example is given above in which 67 dB of noise results in the Surround channel output from the 2:4 MP decode matrix. In the example, the signal applied to the Center channel is 100 dB. Thus, applying teachings of the invention, $L_T$ and $R_T$ are each 97 dB, $L_T'=\frac{1}{2}(L_T+R_T)=97$ dB and $R_T'=\frac{1}{2}(L_T-R_T)=-\infty$ dB (i.e. zero) and of the four signals $L_T$, $R_T$, $L_T'$ and $R_T'$, the smallest is the difference signal ($R_T'$) which results in selection of the alternate matrix by the adaptive rematrix.

Selecting the alternate matrix as the adaptive rematrix causes $L_T'=\frac{1}{2}(L_T+R_T)$ and $R_T'=\frac{1}{2}(L_T-R_T)$ to be sent instead of $L_T$ and $R_T$, respectively. Thus, the 97 dB $L_T$ and $R_T$ signals are converted to a 97 dB sum signal ($L_T'$) and a $-\infty$ dB (i.e., zero) difference signal ($R_T'$). The 97 dB sum signal ($L_T'$) will still pick up 67 dB of noise, while the zero amplitude difference signal picks up no noise. The decode adaptive rematrix reconstructs $(L_T')_D+(R_T')_D$ and $(L_T')_D-(R_T')_D$ from $(L_T')_D$ and $(R_T')_D$, resulting in two 97 dB signals, each with 67 dB of noise, output from the adaptive rematrix to the 2:4 decode matrix. However, in this case the noise in each of the signals is identical instead of being uncorrelated. Consequently, when the 2:4 MP matrix decoder reconstructs the Surround channel by subtracting the two signals, the 97 dB signal components will cancel and so will the 67 dB noise components, resulting in $-\infty$ dB SPL (i.e., no noise or signal) from the Surround channel, a useful improvement.

DETAILED DESCRIPTION OF THE PREFERRED EMBODIMENTS

Figure 1A:
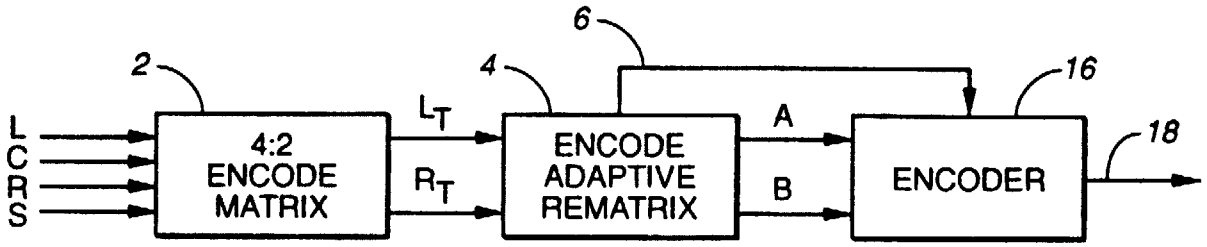
FIG. 1A is a functional block diagram showing an encoding arrangement embodying various aspects of the invention.
Figure 1B:
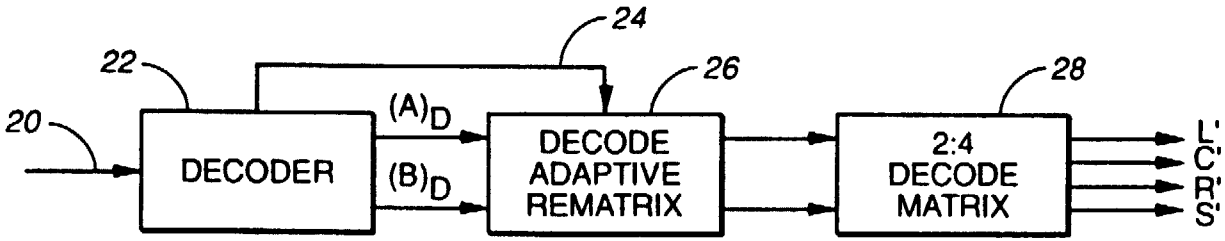
FIG. 1B is a functional block diagram showing a decoding arrangement embodying various aspects of the invention.

Referring now to FIGS. 1A and 1B of the drawings, encoding and decoding arrangements embodying various aspects of the invention are shown. The embodiments of FIGS. 1A and 1B are time-domain embodiments of the invention. The invention may also be expressed in frequency-domain embodiments, described below. In FIG. 1A, four audio signal source inputs L, C, R and S representing the Left, Center, Right and Surround sound channel inputs are shown applied to a 4:2 encoder matrix 2 which produces two output signals $L_T$ and $R_T$ which are weighted sums of the four source signals. The matrix preferably encodes the signals according to the MP encode matrix equations, Equations 1 and 2. The 4:2 matrix 2 may operate either in the analog domain or digital domain or some combination thereof. If it operates wholly or partially in the digital domain, the input and output signals may be parallel as suggested by the drawing or, alternatively, serially multiplexed.

The $L_T$ and $R_T$ encode matrix output signals are applied to an adaptive matrix 4. In some instances, the encode matrix 2 may be widely separated from the adaptive rematrix 4 temporally and/or spatially. For example, the four source signals may have been MP matrix encoded onto the SVA soundtracks of a motion picture many years before they are applied to the adaptive rematrix 4. The adaptive rematrix takes one of two forms: an identity, no change matrix and a sum/difference matrix. Thus, the outputs A and B from the adaptive rematrix 4 are either $L_T$ and $R_T$ from the identity matrix as shown in Equations 1 and 2 or $L_T'=\frac{1}{2}(L_T+R_T)$ in lieu of $L_T$ and $R_T'=\frac{1}{2}(L_T-R_T)$ in lieu of $R_T$ from the alternate sum/difference matrix. A control signal on line 6 indicates which form of the rematrix is in use.

Figure 2:
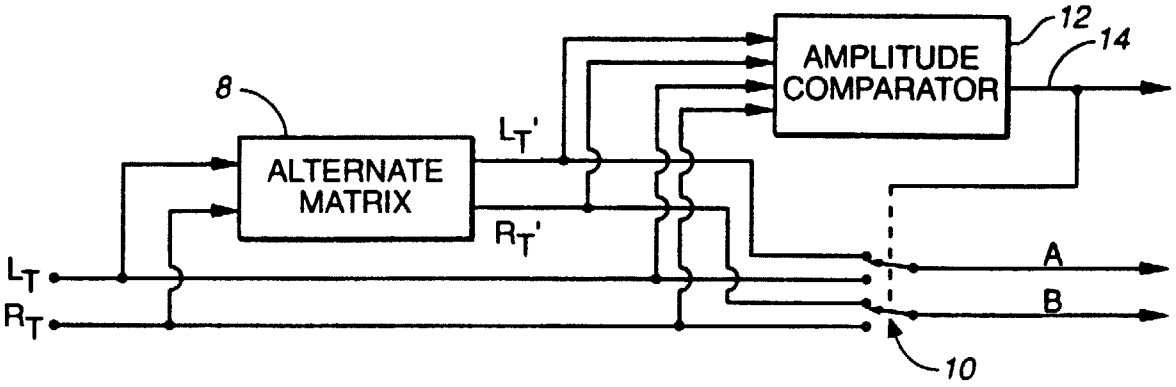
FIG. 2 is a block diagram directed to the adaptive rematrixing function and showing the four-way controller function.

Functional details of the encode adaptive rematrix 4 including its controller are shown in the block diagram of FIG. 2. The $L_T$ and $R_T$ input signals are applied to an alternate matrix 8 and to one pair of input poles of a double-pole double-throw switch 10. The alternate matrix 8 provides as its outputs the weighted sum and weighted difference of its inputs, namely $L_T' = \frac{1}{2}(L_T + R_T)$ and $R_T' = \frac{1}{2}(L_T - R_T)$. The $L_T$ and $R_T$ input signals and the $L_T'$ and $R_T'$ alternate matrix output signals are applied to a four-way amplitude comparator 12. Comparator 12 compares the amplitudes, preferably the RMS amplitudes, of $L_T$, $R_T$, $L_T'$ and notes which is smallest. The signals may be frequency weighted. If the amplitude of $L_T$ or $R_T$ is smallest, the comparator 12, via line 14, causes switch 10 to select the identity matrix (i.e., the $L_T$ and $R_T$ inputs), else the comparator causes switch 10 to select the alternate matrix (i.e., the $L_T'$ and $R_T'$ inputs). The comparator 12 may choose the identity matrix or the alternate matrix periodically or aperiodically. The choice may, for example, be made in accordance with characteristics of the input signals $L_T$ and $R_T$, at regular intervals, and/or in accordance with the encoding operations of an encoder associated with the adaptive rematrix. In the preferred embodiment described hereinafter, audio signals are divided into blocks by an encoder and the state of the adaptive rematrix is chosen for each block.

Referring again to FIG. 1A, the audio signal outputs A and B and the control signal on line 6 from adaptive rematrix and controller 4 are applied to an encoder 16. Encoder 16 may be a psychoacoustically-based low-bit-rate transform or subband coder or it may be some other type of coder combined with transmission or storage and retrieval which generates uncorrelated noise commensurate with signal amplitude in the channel and which noise is uncorrelated between or among the channels. The encoder 16 encodes the audio signals A and B and the control signal on line 6 and provides them at its output 18. The output may be applied to a transmission channel or a storage and retrieval channel which provides the transmitted or stored and retrieved signals to the input 20 of the decoding arrangement of FIG. 1B.

As noted above, the encode matrix 2 may operate in the analog or digital domain or some combination thereof. The encode adaptive rematrix 4 and the decode adaptive matrix of FIG. 2 may also operate in the analog or digital domain or some combination thereof. In addition, the encoder 16 may operate in the analog or digital domain or some combination thereof. Known encoders configured as a psychoacoustically-based low-bit-rate transform or subband coders operate in the digital domain and are usually implemented using digital signal processing techniques. In the digital domain, the control signal on line 6 may be a single control bit.

In FIG. 1A and throughout this document, connections between blocks are shown as one or more lines merely to aid in conceptual understanding. In practice, the actual number of lines may vary from the number shown. For example, although the output 18 from encoder 16 is shown as a single line, the output carries an encoding of the audio signals received by the encoder on lines A and B along with the control signal or control bit on line 6. These outputs could be multiplexed and transmitted in series on output 18. Alternatively, for example, three output lines may be required if the two audio channels and the control signal are put out in parallel.

Although shown as separate blocks, the 4:2 encode matrix 2 and the encode adaptive rematrix 4 may be combined and need not be spatially and/or temporally separated. In practice, the 4:2 encode matrix and the adaptive rematrix functions could be performed together by unitary variable encode matrix hardware or, for example, by digital signal processing. Alternatively, the adaptive rematrix 4 and the encoder 16 may be combined. Both functions could be performed, for example, by a unitary digital signal processing device. If this is done, however, it is preferred to employ the frequency-domain arrangement of FIG. 3A as described hereinafter. Furthermore, all three blocks, the 4:2 encode matrix 2, the adaptive rematrix 4 and the encoder 16 may be combined. It may be possible to perform all three functions by a unitary digital signal processing device.

Referring now to the decoder arrangement of FIG. 1B, input 20 receives the encoded audio signals A and B and the control signal from a transmission channel or a storage and retrieval channel. A decoder 22, similar to the encoder 16, provides audio output signals $(A)_D$ and $(B)_D$ and, on line 24, the control signal. The subscripts indicated that these are decoded audio signals which may have suffered some degradation by transmission or storage and retrieval. $(A)_D$ and $(B)_D$ may be either $(L_T)_D$ and $(R_T)_D$ or $(L_T')_D$ and $(R_T')_D$, respectively, depending on the form of the encode rematrix.

The decoded audio signals, $(A)_D$ and $(B)_D$, and the control signal are applied to a decode adaptive rematrix 26. The decode adaptive rematrix reconstructs the two channels and provides either its inputs $(L_T)_D$ and $(R_T)_D$ or the sum and difference of its inputs $(L_T')_D + (R_T')_D$ and $(L_T')_D - (R_T')_D$ if the control signal indicates that the alternate matrix bit is selected.

The audio signal outputs from the decode adaptive rematrix 26 are applied to the 2:4 decode matrix 28 which provides the four audio signal outputs L', C', R' and S' in accordance with Equations 3 through 6. The prime marks indicate that the four signals representative of the original source signals L, C, R and S are not precisely the same due to deficiencies, such as crosstalk, inherent in 4:2:4 audio matrices and also due to possible degradation of the two-channel signal during transmission or storage and retrieval.

Decoder 22, decode adaptive rematrix 26 and 2:4 decode matrix 28 may also be combined in ways similar to those mentioned in the description of the encoder arrangement. In addition, the various blocks may operate in the analog domain, the digital domain, or a combination thereof, in the same way as discussed with respect to the corresponding elements in the encoder arrangement. Furthermore, the 2:4 dematrix 28 may be temporally and/or spatially separated from the decode adaptive rematrix 26 in a similar way to the corresponding elements of the encoding arrangement.

Figure 3A:
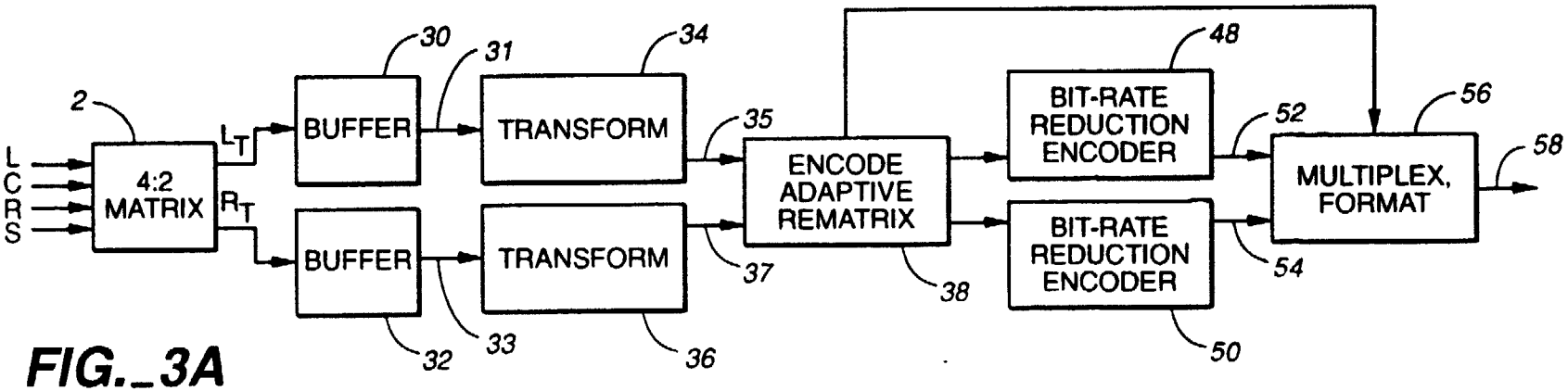
FIG. 3A is a functional block diagram showing a preferred embodiment of an encoder arrangement embodying aspects of the present invention in which the adaptive rematrix function is contained within or forms a functional part of a low-bit-rate psychoacoustically-based encoder.

Referring now to FIG. 3A, a preferred frequency-domain embodiment of an encoder arrangement embodying aspects of the present invention is shown in functional block diagram form. In this arrangement, the adaptive rematrix function is contained within or forms a functional part of a low-bit-rate psychoacoustically-based encoder. The low-bit rate encoder is preferably of the type described in the above cited U.S. Pat. No. 5,109,417 and further described in "High-Quality Audio Transform Coding at 128 kBits/s by Grant Davidson, Louis Fielder and Mike Antill, Dolby Laboratories, Inc., Dolby Technical Papers Publication No. S90/8873, reprinted from *Proceedings of International Acoustics, Speech, and Signal Processing*, Albuquerque, N. Mex., April 1990 or in the above-cited international patent application WO 92/12607.

Alternatively, the adaptive matrix function may be contained within or forms a functional part of other types of low-bit-rate transform coders or within a low-bit-rate subband coder. In each instance, the adaptive matrix function preferably follows the dividing of the audio signal into frequency components and precedes the low-bit-rate encoding of the frequency components.

As in FIG. 1A, four audio signal source inputs L, C, R and S representing the Left, Center, Right and Surround sound channel inputs are applied to a 4:2 encoder matrix 2 which produces two output signals $L_T$ and $R_T$ which are weighted sums of the four source signals. The matrix preferably encodes the signals according to the MP encode matrix equations, Equations 1 and 2. The 4:2 matrix 2 may operate either in the analog domain or digital domain or some combination thereof.

The $L_T$ and $R_T$ outputs of encode matrix 2 are applied to respective buffers 30 and 32. In some instances, the encode matrix 2 may be widely separated temporally and/or spatially from the buffers 30 and 32 and the subsequent blocks in FIG. 3A. Blocks 30 and 32 and the subsequent blocks in FIG. 3A operate in the digital domain. Thus, if the $L_T$ and $R_T$ signals from encode matrix 2 are analog, they must be converted to digital form by suitable means (not shown) prior to application to blocks 30 and 32. In the preferred embodiment, the digital form is 16- or more bit linear PCM and the PCM input signals in the time domain are divided into blocks and windowed along with buffering in blocks 30 and 32. As is well known in the art, windowing of the time-domain blocks is required when certain transforms are employed.

The output from blocks 30 and 32 are applied, via lines 31 and 33, to respective time-domain to frequency-domain transforms 34 and 36 which represent the blocks of audio signals as sets of frequency component. These functions are well known in the low-bit-rate coding art and are described in the cited '417 patent, international published application and Davidson et al paper. In the preferred embodiment the transform employs Time-Domain Aliasing Cancellation (TDAC) and consists of alternating Modified Discrete Cosine and Modified Discrete Sine transforms (MDCT and MDST, respectively). The TDAC transform requires windowing of the input sample blocks.

The encode adaptive rematrix 38 receives, via lines 35 and 37, the frequency component representations of the $L_T$ and $R_T$ signals and provides either the same frequency components, $(L_T)_f$ and $(R_T)_f$, at its output or the weighted sum and difference thereof, $(L_T')_f = \frac{1}{2}(L_T + R_T)_f$ and $(R_T')_f = \frac{1}{2}(L_T - R_T)_f$ in a manner similar to adaptive rematrix 4 of FIG. 1A. The "f" subscript indicates that the signal is a frequency component representation.

The adaptive rematrix 38 applies a bit on line 42 for each block, indicating if the identity or alternate matrix is selected. The audio information, in the form of frequency component representations from adaptive rematrix 38 on lines 44 and 46, is applied, respectively, to bit-rate reduction encoders 48 and 50. As mentioned above, the bit-rate reduction encoders add uncorrelated noise to the audio signals commensurate with their amplitude. The noise is uncorrelated between the two encoded channels. The outputs from encoders 48 and 50 on lines 52 and 54 are applied along with the matrix selection indicating bit on line 42 to the multiplex and format block 56. Block 56 multiplexes the signals input to it and formats the signals for output at 58. If desired, it may also apply error correction encoding. The output 58 may be applied to a transmission channel or a storage and retrieval channel which provides the transmitted or stored and retrieved signals to the input 60 of the decoding arrangement of FIG. 3B.

Although shown as separate blocks, the 4:2 encode matrix 2 and the elements of the low-bit-rate encoder, including adaptive rematrix 38, may be combined and need not be spatially and/or temporally separated. It may be possible to configure the 4:2 encode matrix as a functional part of the same digital processing that provides the low-bit-rate encoding and adaptive rematrixing.

Figure 3B:
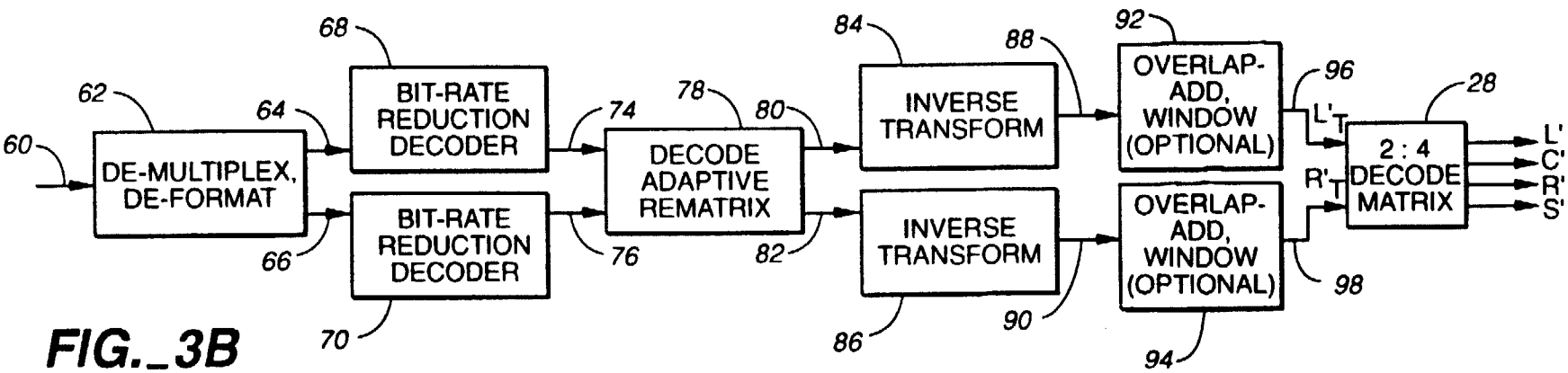
FIG. 3B is a functional block diagram showing a preferred embodiment of a decoder arrangement embodying aspects of the present invention in which the decode adaptive rematrix function is contained within or forms a functional part of a low-bit-rate psychoacoustically-based decoder.

Referring now to the decoder arrangement of FIG. 3B, input 60 receives the encoded audio signals and the matrix selection indicating bit from a transmission channel or a storage and retrieval channel. A block 62 processes the received signals by de-multiplexing and deformatting them in order to provide the two bit-rate reduced audio signals on lines 64 and 66 to the respective bit-rate reduction decoders 68 and 70 and the matrix selection control signal on line 72. If the encoder arrangement applied error correction encoding, block 62 also provides the appropriate error correction decoding. The frequency component outputs from decoders 68 and 70 on lines 74 and 76, respectively, are subject to degradation by transmission or storage and retrieval and by the bit-rate-reduction encode/decode process.

The signals on lines 74 and 76 and the control signal are applied to the decode adaptive rematrix 78. The adaptive rematrix reconstructs the frequency components representing the two channels and provides either its inputs $[(L_T)_f]_D$ and $[(R_T)_f]_D$ or the sum and difference of its inputs $[(L_T')_f]_D + [(R_T')_f]_D$ and $[(L_T')_f]_D - [(R_T')_f]_D$ if the control signal indicates that the alternate matrix bit is selected.

The audio signal frequency component outputs from the adaptive rematrix 78 are applied via lines 80 and 82 to respective inverse transforms 84 and 86 to transform the frequency components into time-domain signals. In the preferred embodiment in which the encoding arrangement overlaps and windows blocks of buffered input signals, the decoding arrangement has overlap-add and window blocks 92 and 94 receiving the outputs of the inverse transforms via lines 88 and 90. The optional blocks 92 and 94 window, overlap and add adjacent sample blocks to cancel the weighting effects of the encoding analysis window and the decoding synthesis window. Blocks 92 and 94 provide the $L_T'$ and $R_T'$ signals on lines 96 and 98 to the 2:4 decode matrix 28 which provides the four audio signal outputs L', C', R' and S'. The prime marks indicate that the four signals representative of the original source signals L, C, R and S are not precisely the same due to inherent shortcomings of 4:2:4 audio matrices and also due to possible degradation of the two-channel signal during transmission or storage and retrieval.

Although shown as separate blocks, the 2:4 decode matrix 28 and the elements of the low-bit-rate decoder, including adaptive rematrix 78, may be combined and need not be spatially and/or temporally separated. Alternatively, the 2:4 dematrix 28 may be temporally and/or spatially separated from the elements of the low-bit-rate decoder which incorporates the adaptive rematrix 78. In addition, it may be possible to configure the 2:4 encode decode matrix as a functional part of the same digital processing that provides the low-bit-rate decoding and adaptive rematrixing.

Figure 4:
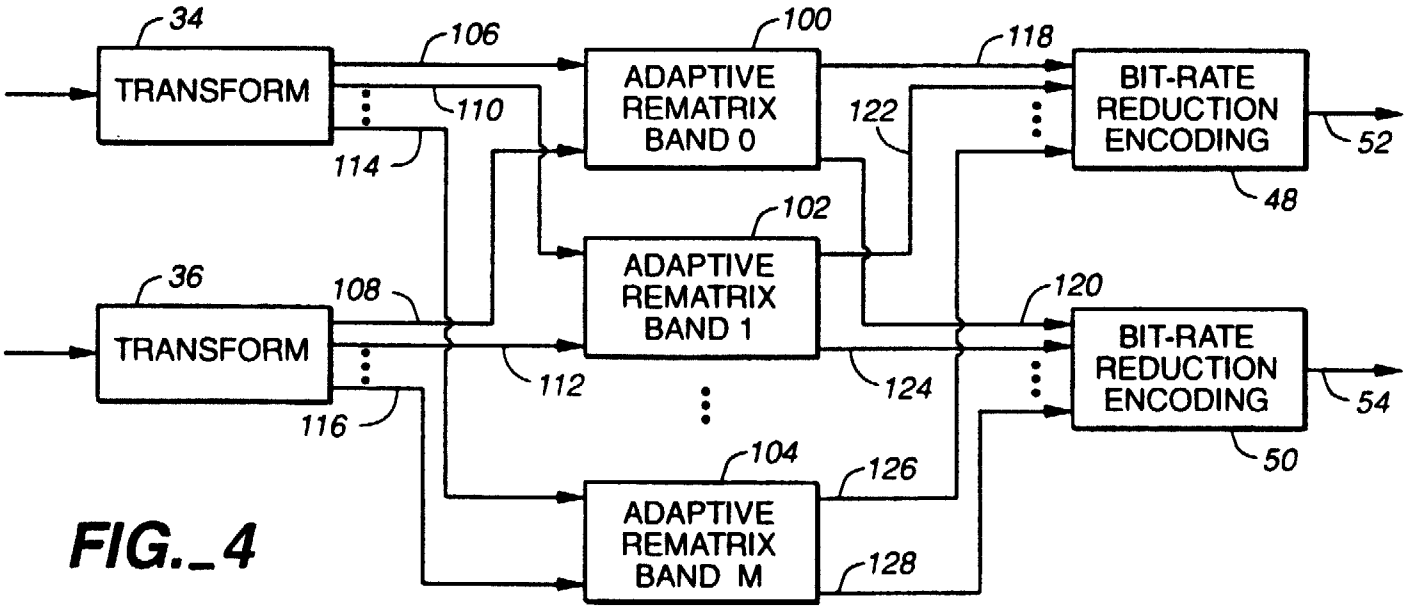
FIG. 4 is a functional block diagram showing a modification of the encoder arrangement of FIG. 3A in which an independent adaptive rematrix is provided for each frequency band or, alternatively, for groups of bands.

FIG. 4 shows a modification of the encoder arrangement of FIG. 3A. It will be apparent to those of ordinary skill in the art that a similar modification may be made to the decoder arrangement of FIG. 3B. In transform coders, including the transform coder preferably used in the arrangement of FIG. 3A, the frequency component outputs of the transform (i.e., transform frequency coefficients) are grouped into sets of transform coefficients or bins representing frequency bands. Instead of applying all of the frequency component outputs to the same adaptive rematrix, it is believed that improved performance may be obtained by providing an independent adaptive rematrix for each band or, alternatively, for groups of bands.

In FIG. 4, the outputs of transforms 34 and 36 are applied to separate adaptive rematrix blocks 100, 102 and 104 for bands O through m. Thus, the band O output from transform 34 on line 106 is applied to one input of rematrix 100 and the band O output of transform 36 is applied on line 108 to the other input of band O rematrix 100. In the same way, the band 1 output of transform 34 is applied via line 110 to one input of rematrix 102 while the band 1 output of transform 36 is applied to the other input of band 1 rematrix 102. Finally, the band m output of transform 34 on line 114 is applied to one input of rematrix 104 and the band m output of transform 36 on line 116 is applied to the other input of band m rematrix 104. Lines 118, 120, 122, 124, 126 and 128 apply the various adaptive rematrix outputs to the appropriate bit-rate reduction encoders 48 and 50. The lines between transforms 34, 36 and the adaptive rematrix blocks 100, 102 and 104 and between adaptive rematrix blocks and the bit-rate reduction encoders 48 and 50 may represent the application of one or more transform coefficients to a rematrix block because band groupings may include one or more coefficients. Each of the adaptive rematrices 100, 102, 104, etc. provides a control signal output in the manner of line 6 of FIG. 1A. The control signal paths are not shown in FIG. 4 in order to simplify the drawing.

We claim:

1. Apparatus for adaptively rematrixing the audio output signals of a 4:2 audio signal matrix for coding, transmission, or storage and retrieval in a system in which the noise level varies with signal amplitude level, comprising means for determining which of the signals among the matrix output signals and the sum and difference of the matrix output signals has the smallest amplitude, and means for applying the matrix output signals to the coding, transmission, or storage and retrieval if one of the matrix output signals has the smallest amplitude and for applying the sum and difference of the matrix output signals to the coding, transmission, or storage and retrieval if one of the sum and difference of the matrix output signals has the smallest amplitude.

2. The apparatus of claim 1 wherein the sum of the matrix output signals is an amplitude weighted sum and the difference of the matrix output signals is an amplitude weighted difference.

3. Apparatus for adaptively matrixing four audio input signals into two signals for coding, transmission, or storage and retrieval in a system in which the noise level varies with signal amplitude level, comprising 4:2 audio matrix means receiving said four audio input signals for providing two matrix output signals, and adaptive rematrixing means for selectively applying the matrix output signals or the sum and difference of the matrix output signals to the coding, transmission, or storage and retrieval.

4. The apparatus of claim 3 wherein said adaptive rematrixing means determines which of the signals among the matrix output signals and the sum and difference of the matrix output signals has the smallest amplitude, and applies the matrix output signals to the coding, transmission, or storage and retrieval if one of the matrix output signals has the smallest amplitude and applies the sum and difference of the matrix output signals to the coding, transmission, or storage and retrieval if one of the sum and difference of the matrix output signals has the smallest amplitude.

5. The apparatus of claim 3 wherein the sum of the matrix output signals is a amplitude weighted sum and the difference of the matrix output signals is an amplitude weighted difference.

6. An adaptive audio encoding matrix, comprising

4:2 audio matrix means receiving four audio source signals L, C, R, and S for providing two matrix encoded audio signals $L_T$ and $R_T$ in response thereto, and means for adaptively changing the matrix encoding characteristics of said 4:2 audio matrix means such that the matrix means provides as its output two signals $L_T$ and $R_T$ generally in accordance with the relationships $$L_T = L + 0.707C + 0.707S,$$

and $$R_T = R + 0.707C - 0.707S$$

when $L_T$ or $R_T$ has the smallest amplitude among $L_T$, $R_T$, $k(L_T+R_T)$, and $k(L_T-R_T)$ and provides as its output two signals $L_T'$ and $R_T'$ generally in accordance with the relationships $$L_T' = k(L_T + R_T) = k(L + R + \sqrt{2}\ C), \text{ and}$$

$$R_T' = k(L_T - R_T) = k(L - R + \sqrt{2}\ S)$$

when $k(L_T+R_T)$ or $k(L_T-R_T)$ has the smallest amplitude among $L_T$, $R_T$, $L_T'$ and $R_T'$ where k is a constant.

7. Apparatus for use in an encoder for a signal transmission or storage and retrieval system in which audio signals in the encoder are represented as frequency components and the frequency components are subject to bit-rate reduction encoding, the encoder having a noise level which varies with signal amplitude level, the encoder receiving the audio output signals of a 4:2 audio signal matrix, the apparatus adaptively rematrixing frequency component representations of the 4:2 matrix output signals, comprising means for determining which of the signals among the matrix output signals and the sum and difference of the matrix output signals has the smallest amplitude, and means for applying the frequency component representations of the matrix output signals to the bit-rate reduction encoding if one of the matrix output signals has the smallest amplitude and for applying the sum and difference of the matrix output signals to the bit-rate reduction encoding if one of the sum difference of the matrix output signals has the smallest amplitude.

8. The apparatus of claim 7 wherein the sum of the matrix output signals is an amplitude weighted sum and the difference of the matrix output signals is an amplitude weighted difference.

9. An encoder for a signal transmission or storage and retrieval system, the encoder receiving the output signals of a 4:2 audio signal matrix, comprising means for dividing the matrix output signals into frequency components, bit-rate reduction encoding means, said bit-rate reduction encoding means having a noise level which varies with signal amplitude level, and adaptive rematrixing means for determining which of the signals among the matrix output signals and the sum and difference of the matrix output signals has the smallest amplitude, and for applying frequency components representing the matrix output signals to the coding, transmission, or storage and retrieval if one of the matrix output signals has the smallest amplitude and for applying frequency components representing the sum and difference of the matrix output signals to the coding, transmission, or storage and retrieval if one of the sum and difference of the matrix output signals has the smallest amplitude.

10. The apparatus of claim 9 wherein the sum of the matrix output signals is an amplitude weighted sum and the difference of the matrix output signals is an amplitude weighted difference.

11. An adaptive 4:2 audio matrix and encoder for a signal transmission or storage and retrieval system, said matrix and encoder adapted to receive four audio input signals, comprising 4:2 matrix means receiving said four input signals for providing two matrix output signals, means for dividing the matrix output signals into frequency components, bit-rate reduction encoding means, said bit-rate reduction encoding means having a noise level which varies with signal amplitude level, and adaptive rematrixing means for determining which of the signals among the matrix output signals and the sum and difference of the matrix output signals has the smallest amplitude, and for applying frequency components representing the matrix output signals to the coding, transmission, or storage and retrieval if one of the matrix output signals has the smallest amplitude and for applying frequency components representing the sum and difference of the matrix output signals to the coding, transmission, or storage and retrieval if one of the sum and difference of the matrix output signals has the smallest amplitude.

12. The apparatus of claim 11 wherein the sum of the matrix output signals is an amplitude weighted sum and the difference of the matrix output signals is an amplitude weighted difference.

13. The apparatus of claim 9 or 11 wherein said means for dividing the matrix output signals into frequency components includes means for dividing the matrix output signals into time blocks and means for applying a transform to each of said blocks to produce a set of transform frequency coefficients.

14. The apparatus of claim 13 wherein said adaptive rematrixing means operates with respect to each time block and set of transform frequency coefficients.

15. The apparatus of claim 13 wherein said means for applying a transform also groups transform frequency coefficients into frequency bands, and wherein said adaptive rematrixing means operates independently with respect to each or selected ones of frequency band grouped transform coefficients.

16. The apparatus of claim 9 or 11 wherein said means for dividing the matrix output signals into frequency components includes filter bank means.

17. The apparatus of claim 9 or 11 wherein said means for dividing the matrix output signals into frequency components includes quadrature mirror filter means.

18. The apparatus of claim 3 or 11 wherein said 4:2 audio matrix means provides two output signals in response to four input signals generally in accordance with the relationships $$L_T = L + 0.707C + 0.707S,$$

and $$R_T = R + 0.707C - 0.707S$$

where, L is Left channel signal, R is the Right channel signal, C is the Center channel signal and S is the Surround channel signal.

19. The apparatus of claim 3 or 11 wherein the combined action of said 4:2 audio matrix means and said adaptive rematrixing means provides as its output two signals $L_T$ and $R_T$ generally in accordance with the relationships $$L_T = L + 0.707C + 0.707S,$$

and $$R_T = R + 0.707C - 0.707S$$

when $L_T$ or $R_T$ has the smallest amplitude among $L_T$, $R_T$, $k(L_T+R_T)$, and $k(L_T-R_T)$ and provides as its output two signals $L_T'$ and $R_T'$ generally in accordance with the relationships $$L_T' = k(L_T + R_T) = k(L + R + \sqrt{2}\ C), \text{ and}$$

$$R_T' = k(L_T - R_T) = k(L - R + \sqrt{2}\ S)$$

when $L_T'$ or $R_T'$ has the smallest amplitude among $L_T$, $R_T$, $L_T'$ and $R_T'$ where, L is Left channel signal, R is the Right channel signal, C is the Center channel signal, S is the Surround channel signal and k is a constant.

20. In a system for coding, transmission, or storage and retrieval of audio signals received from a 4:2 audio signal encoding matrix and applied to a complementary 2:4 audio decoding matrix, the system having a noise level which varies with signal amplitude level, apparatus comprising means for determining which of the signals among the encoding matrix output signals and the sum and difference of the encoding matrix output signals has the smallest amplitude, means for applying the encoding matrix output signals to the coding, transmission, or storage and retrieval if one of the encoding matrix output signals has the smallest amplitude and for applying the sum and difference of the encoding matrix output signals to the coding, transmission, or storage and retrieval if one of the weighted sum and weighted difference of the encoding matrix output signals has the smallest amplitude, said means for applying also applying a control signal to the coding, transmission, or storage and retrieval indicating if the encoding matrix output signals or the sum and difference of the encoding matrix output signals is being applied to the transmission or storage, and means receiving said matrix output signals or the sum and difference of the matrix output signals, and said control signal from the coding, transmission, or storage and retrieval, said means recovering unaltered, for use by the complementary 2:4 decoding matrix, the received signals when said means for applying applied the matrix encoder output signals to the coding, transmission, or storage and retrieval and for recovering the sum and difference of the received signals, for use by the complementary 2:4 decoding matrix, when the means for applying applied the sum and difference of the matrix encoder output signals to the coding, transmission, or storage and retrieval.

21. The apparatus of claim 20 wherein the sum of the encoding matrix output signals is an amplitude weighted sum and the difference of the encoding matrix output signals is an amplitude weighted difference.

22. In a 4:2:4 matrix system for coding, transmission, or storage and retrieval of four audio signals on a two-channel medium, the system having a channel noise level which varies with signal amplitude level, apparatus comprising 4:2 audio encoding matrix means receiving said four audio signals for providing two matrix encoded output signals, adaptive rematrixing means for determining which of the signals among the encoding matrix output signals and the sum and difference of the encoding matrix output signals has the smallest amplitude, and for applying the encoding matrix output signals to the coding, transmission, or storage and retrieval if one of the encoding matrix output signals has the smallest amplitude and for applying the sum and difference of the encoding matrix output signals to the coding, transmission, or storage and retrieval if one of the sum and difference of the matrix output signals has the smallest amplitude, said adaptive matrix means also applying a control signal to the coding, transmission, or storage and retrieval indicating if the encoding matrix output signals or the sum and difference of the encoding matrix output signals is being applied to the coding, transmission, or storage and retrieval, decode adaptive rematrixing means receiving said encoding matrix output signals or the sum and difference of the encoding matrix output signals and said control signal from the coding, transmission, or storage and retrieval, said means recovering the received signals unaltered when said adaptive rematrixing means applied the matrix encoder output signals to the coding, transmission, or storage and retrieval and for recovering the sum and difference of the received signals when the adaptive rematrixing means applied the sum and difference of the matrix encoder output signals to the coding, transmission, or storage and retrieval, and complementary 2:4 audio decoding matrix means receiving the unaltered received signals or the sum and difference of the received signals for providing four matrix output signals representing the four audio signals applied to the 4:2 audio matrix encoding means.

23. The apparatus of claim 22 wherein the sum of the encoding matrix output signals is an amplitude weighted sum and the difference of the encoding matrix output signals is an amplitude weighted difference.

24. The apparatus of claim 22 wherein said 4:2 audio matrix means provides two output signals in response to four input signals generally in accordance with the relationships $$L_T = L + 0.707C + 0.707S,$$

and $$R_T = R + 0.707C - 0.707S$$

where, L is Left channel signal, R is the Right channel signal, C is the Center channel signal and S is the Surround channel signal and said complementary 2:4 audio decoding matrix means provides four output signals in response to two input signals generally in accordance with the relationships $$L' = L_T = L + 0.707(C + S),$$

$$R' = R_T = R + 0.707(C - S),$$

$$C' = (L_T + R_T)/\sqrt{2} = C + 0.707(L + R), \text{ and}$$

$$S' = (L_T - R_T)/\sqrt{2} = S + 0.707(L - R).$$

25. The apparatus of claim 22 wherein the combined action of said 4:2 audio matrix means and said adaptive rematrixing means provides as its output two signals $L_T$ and $R_T$ generally in accordance with a first set of relationships $$L_T = L + 0.707C + 0.707S,$$

and $$R_T = R + 0.707C - 0.707S$$

when $L_T$ or $R_T$ has the smallest amplitude among $L_T$, $R_T$, $k(L_T+R_T)$, and $k(L_T-R_T)$ and provides as its output two signals $L_T'$ and $R_T'$ generally in accordance with a second set of relationships $$L_T' = \tfrac{1}{2}(L_T + R_T) = \tfrac{1}{2}(L + R + \sqrt{2}\,C), \text{ and}$$

$$R_T' = \tfrac{1}{2}(L_T - R_T) = \tfrac{1}{2}(L - R + \sqrt{2}\,S)$$

when $L_T'$ or $R_T'$ has the smallest amplitude among $L_T$, $R_T$, $L_T'$ and $R_T'$, where L, C, R, and S are the four audio signals received by the encoding matrix means, and wherein the combined action of said decode adaptive rematrixing means and said complementary 2:4 audio decoding matrix means provides as its output four signals L', C', R', S' representing the four audio signals applied to the 4:2 audio matrix encoding means generally in accordance with the relationships $$L' = (L_T')_D$$

$$R' = (R_T')_D$$

$$C' = [(L_T')_D + (R_T')_D]/\sqrt{2}$$

$$S' = [(L_T')_D - R_T')_D]/\sqrt{2}$$

when the control signal indicates that the adaptive encoding matrixing encoded the $L_T$ and $R_T$ signals in accordance with said first state of relationships, and wherein the second state of said adaptive 2:4 audio matrix decoding means provides as its output four signals L', C', R', S' representing the four audio signals applied to the 4:2 audio matrix encoding means generally in accordance with the relationships $$L' = (L_T')_D + (R_T')_D$$

$$R' = (L_T')_D - (R_T')_D$$

$$C' = (L_T')_D\sqrt{2}$$

$$S' = (R_T')_D\sqrt{2}$$

when the control signal indicates that the adaptive encoding matrix encoded $L_T'$ and $L_T'$ in accordance with said second state of relationships, where the subscript D indicates decoded values of the respective signals.

26. An adaptive audio encoding and decoding matrix system for use with signal coding, transmission, or storage and retrieval, comprising adaptive 4:2 audio matrix means receiving four audio source signals L, C, R, and S for providing two matrix encoded audio signals $L_T$ and $R_T$ in response thereto for application to signal coding, transmission, or storage, the output signals $L_T$ and $R_T$ having characteristics such that $$L_T = L + 0.707C + 0.707S,$$

and $$R_T = R + 0.707C - 0.707S$$

when $L_T$ or $R_T$ has the smallest amplitude among $L_T$, $R_T$, $k(L_T+R_T)$, and $k(L_T-R_T)$, where k is a constant, and the output signals $L_T$ and $R_T$ having characteristics such that $$L_T' = k(L_T + R_T) = k(L + R + \sqrt{2}\ C), \text{ and}$$

$$R_T' = k(L_T - R_T) = k(L - R + \sqrt{2}\ S)$$

when $L_T'$ or $R_T'$ has the smallest amplitude among $L_T$, $R_T$, $L_T'$ and $R_T'$, said means for adaptively changing the matrix encoding characteristics of said 4:2 audio matrix also producing a control signal indicating which set of relationships define the output signals $L_T$, $R_T$, $L_T'$ and $R_T'$, and complementary adaptive 2:4 audio matrix decoding means receiving said signals $L_T$ and $R_T$ or $L_T'$ and $R_T'$ along with said control signal from said coding, transmission, or storage and retrieval for providing four decoded signals L', C', R' and S' representative of said four audio source signals.

27. Apparatus for use in a signal coding, transmission, or storage and retrieval system in which audio signals are divided into frequency components and the frequency components are subject to bit-rate reduction encoding before application to the coding, transmission, or storage and retrieval, and the encoded signals from the coding, transmission, or storage and retrieval are subject to bit-rate reduction decoding and the decoded frequency components are assembled into representations of the audio signals applied to the system, the system having a noise level which varies with signal amplitude, the system receiving the two audio output signals of a 4:2 audio signal encoding matrix and the system applying the representations of the audio signals to a 2:4 audio signal decoding matrix, comprising adaptive rematrixing means receiving said frequency components for determining which of the signals among the encoding matrix output signals and the sum and difference of the encoding matrix output signals has the smallest amplitude, and for applying frequency components representing the encoding matrix output signals to the bit-rate reduction encoding if one of the encoding matrix output signals has the smallest amplitude and for applying the sum and difference of the encoding matrix output signals to the bit-rate reduction encoding if one of the sum and difference of the matrix output signals has the smallest amplitude, said adaptive matrix means also producing a control signal indicating if frequency components representing the encoding matrix output signals or the sum and difference of the encoding matrix output signals are being applied to the bit-rate reduction encoding, and decode adaptive rematrixing means receiving said control signal and frequency component representations of said encoding matrix output signals or the sum and difference of the encoding matrix output signals from the bit-rate reduction decoding, said means recovering the received signals unaltered when said adaptive rematrixing means applied frequency representations of the matrix encoder output signals to the bit-rate reduction encoding and recovering frequency component representations of the sum and difference of the received signals when the adaptive rematrixing means applied frequency representations of the sum and difference of the matrix encoder output signals to the coding, transmission, or storage and retrieval.

28. The apparatus of claim 27 wherein the sum of the encoding matrix output signals is an amplitude weighted sum and the difference of the encoding matrix output signals is an amplitude weighted difference.

29. The apparatus of claim 27 wherein the frequency components are grouped into frequency bands, and wherein said adaptive rematrixing means and said decode adaptive rematrixing means operate independently with respect to each or selected ones of frequency band grouped frequency components.

30. In a system in which the noise level varies with signal amplitude level, apparatus for adaptively rematrixing signals received from coding, transmission, or storage and retrieval in response to a control signal also received from the coding, transmission, or storage and retrieval for applying the adaptively rematrixed signals to a 2:4 audio decoding matrix, the received signals resulting from encoding by a 4:2 audio signal encoding matrix and adaptive rematrixing of the encoding matrix output signals such that in one state of the adaptive rematrixing the signals applied to the coding, transmission, or storage and retrieval are the output of the encoding matrix and in another state of the adaptive rematrixing the signals applied to the coding, transmission, or storage and retrieval are the amplitude weighted sum and difference of the output of the encoding matrix, said control signal indicating the state of the adaptive rematrixing, comprising decode adaptive rematrixing means receiving said matrix output signals or the amplitude weighted sum and difference of the matrix output signals from the coding, transmission, or storage and retrieval for producing audio signals representing the output of said 4:2 encoding matrix for application to said 2:4 decoding matrix, said means having a first state for recovering the signals unaltered from the coding, transmission, or storage and retrieval and a second state for recovering the sum and difference of the signals from the coding, transmission, or storage and retrieval, and means receiving said control signal from said coding, transmission, or storage and retrieval for controlling said decode adaptive rematrixing means in response to said control signal, such that the decode adaptive rematrixing means operates in said first state when the matrix encoder output signals are applied to the coding, transmission, or storage and retrieval and the decode adaptive rematrixing means operates in said second state when the sum and difference of the matrix encoder output signals are applied to the coding, transmission, or storage and retrieval.

31. The apparatus of claim 30 wherein the sum of the encoding matrix output signals is an amplitude weighted sum and the difference of the encoding matrix output signals is an amplitude weighted difference.

32. In a system in which the noise level varies with signal amplitude level, apparatus for adaptively matrix decoding signals received from coding, transmission, or storage and retrieval in response to a control signal also received from the coding, transmission, or storage and retrieval, the received signals resulting from encoding of four audio source signals prior to application to said coding, transmission, or storage and retrieval by adaptive 4:2 audio signal matrix encoding such that in a second state of the adaptive matrix the matrix outputs are the sum and difference of the outputs of the adaptive matrix in its first state, said control signal indicating the state of the adaptive matrix, comprising decode adaptive dematrixing means receiving from said coding, transmission, or storage and retrieval the signals from the adaptive 4:2 audio signal encoding for producing four audio signals representing the four audio source signals, the dematrixing means including 2:4 matrix decoding means and means for adaptively applying the received signals to said 2:4 matrix decoding means in a first state of operation and the sum and difference of the received signals to said 2:4 matrix decoding means in a second state of operation, and means receiving said control signal from said coding, transmission, or storage and retrieval for controlling said decode adaptive dematrixing means in response to said control signal, such that the decode adaptive dematrixing means operates in the first state when the adaptive matrix encoding is in the first state and operates in the second state when the adaptive matrix encoding is in the second state.

33. In a system in which the noise level varies with signal amplitude level, apparatus for adaptively rematrixing and 2:4 matrix decoding signals received from coding, transmission, or storage and retrieval in response to a control signal also received from the coding, transmission, or storage and retrieval, the received signals resulting from encoding of four audio source signals prior to application to said coding, transmission, or storage and retrieval by a 4:2 audio signal encoding matrix and adaptive rematrixing of the encoding matrix output signals such that in one state of the adaptive rematrixing the signals applied to the coding, transmission, or storage and retrieval are the output of the encoding matrix and in another state of the adaptive rematrixing the signals applied to the coder, transmission or storage are the amplitude weighted sum and difference of the output of the encoding matrix, said control signal indicating the state of the adaptive rematrixing, comprising decode adaptive rematrixing means receiving said encoding matrix output signals or the sum and difference of the encoding matrix output signals and said control signal from the coding, transmission, or storage and retrieval, said means recovering the received signals unaltered when said adaptive rematrixing means applied the matrix encoder output signals to the coding, transmission, or storage and retrieval and for recovering the sum and difference of the received signals when the adaptive rematrixing means applied the sum and difference of the matrix encoder output signals to the coding, transmission, or storage and retrieval, and complementary 2:4 audio decoding matrix means receiving the unaltered received signals or the sum and difference of the received signals for providing four matrix output signals representing the four audio signals applied to the 4:2 audio encoding matrix.

34. The apparatus of claim 33 wherein the sum of the encoding matrix output signals is an amplitude weighted sum and the difference of the encoding matrix output signals is an amplitude weighted difference.

35. Apparatus for adaptively matrix decoding signals received from coding, transmission, or storage and retrieval in response to a control signal also received from the coding, transmission, or storage and retrieval, the received signals resulting from the adaptive audio 4:2 matrix encoding of four audio source signals L, C, R, and S such that the adaptive matrix encoding operates in a first state providing two matrix encoded audio signals $L_T$ and $R_T$ having characteristics such that $$L_T = L + 0.707C + 0.707S,$$

and $$R_T = R + 0.707C - 0.707S$$

when $L_T$ or $R_T$ had the smallest amplitude among $L_T$, $R_T$, $k(L_T+R_T)$, and $k(L_T-R_T)$, where k is a constant and the adaptive matrix encoding operates in a second state providing two matrix encoded audio signals $L_T'$ and $R_T'$ having characteristics such that $$L_T' = k(L_T + R_T) = k(L + R + \sqrt{2}\ C), \text{ and}$$

$$R_T' = k(L_T - R_T) = k(L - R + \sqrt{2}\ S)$$

when $L_T'$ or $R_T'$ had the smallest amplitude among $L_T$, $R_T$, $L_T'$ and $R_T'$, the adaptive audio matrix encoding also producing a control signal indicating which set of relationships defined the output signals $L_T$ and $R_T$ or $L_T'$ and $R_T'$, comprising decode adaptive 2:4 audio matrix decoding means receiving said $L_T$ and $R_T$ or $L_T'$ and $R_T'$ signals from said coding, transmission, or storage and retrieval for providing four decoded signals L', C', R' and S' representative of the corresponding four audio source signals, the decode adaptive 2:4 audio matrix decoding means including 2:4 matrix decoding means and means for adaptively applying the received signals to said 2:4 matrix decoding means in a first state of operation and the sum and difference of the received signals to said 2:4 matrix decoding means in a second state of operation, and means receiving said control signal from said coding, transmission, or storage and retrieval for controlling said decode adaptive matrix decoding means in response to said control signal, such that the decode adaptive matrix decoding means operates in the first state when the adaptive matrix encoding is in the first state and operates in the second state when the adaptive matrix encoding is in the second state.

36. The apparatus of claim 35 wherein said adaptive 2:4 audio matrix decoding means provides as its output four signals L', C', R', S' representing the four audio signals applied to the 4:2 adaptive audio matrixing generally in accordance with the relationships $$L' = L_T = L + 0.707(C + S),$$

$$R' = R_T = R + 0.707(C - S),$$

$$C' = (L_T + R_T)/\sqrt{2} = C + 0.707(L + R), \text{ and}$$

$$S' = (L_T - R_T)/\sqrt{2} = S + 0.707(L - R).$$

37. In a system in which the noise level varies with signal amplitude level, apparatus for use in a decoder complementary to an encoder in which audio signals are divided into frequency components and the frequency components are subject to bit-rate reduction encoding, the decoder receiving the output of the encoder via transmission or storage and retrieval, wherein the decoder bit-rate-reduction decodes and assembles decoded frequency components into representations of the audio signals applied to the encoder, the encoder receiving the two audio output signals of a 4:2 audio signal encoding matrix and the decoder applying decoded representations of the audio signals to a 2:4 audio signal decoding matrix, the encoder adaptively rematrixing frequency component representations of the 4:2 encoding matrix output signals such that in one state of the adaptive rematrixing the signals applied to the bit-rate reduction for transmission or storage are frequency components representations of the output of the encoding matrix and in another state of the adaptive rematrixing the signals applied to the bit-rate reduction encoding for transmission or storage are frequency component representations of the sum and difference of the output of the encoding matrix, said adaptive matrixing producing a control signal indicating the state of the adaptive rematrixing, comprising decode adaptive rematrixing means receiving from the decoder bit-rate reduction decoded frequency component representations of said 4:2 encoder matrix output signals unaltered or the sum and difference thereof for producing frequency components which are assembled by the decoder into representations of the audio signals applied to the encoder by the 4:2 encoding matrix, the decode adaptive rematrixing means having a first state with characteristics substantially the same as the first state of the adaptive matrix encoding and a second state with characteristics substantially the same as the second state of the adaptive matrix encoding, and means receiving said control signal from said transmission or storage and retrieval for controlling said decode adaptive rematrixing means in response to said control signal, such that the decode adaptive rematrixing means operates in said first state when the matrix encoder output signals are applied to the transmission or storage and retrieval and the decode adaptive rematrixing means operates in said second state when the sum and difference of the matrix encoder output signals are applied to the transmission or storage and retrieval.

38. The apparatus of claim 37 wherein the sum of the encoding matrix output signals is an amplitude weighted sum and the difference of the encoding matrix output signals is an amplitude weighted difference.

39. The apparatus of claim 37 wherein the frequency components are grouped into frequency bands, and wherein said decode adaptive rematrixing means operates independently with respect to each or selected ones of frequency band grouped frequency components.

40. A method for adaptively rematrixing the audio output signals of a 4:2 audio signal matrix for coding, transmission, or storage and retrieval in a system in which the noise level varies with signal amplitude level, comprising determining which of the signals among the matrix output signals and the sum and difference of the matrix output signals has the smallest amplitude, and applying the matrix output signals to the coding, transmission, or storage and retrieval if one of the matrix output signals has the smallest amplitude and for applying the sum and difference of the matrix output signals to the coding, transmission, or storage and retrieval if one of the sum and difference of the matrix output signals has the smallest amplitude.

41. The method of claim 40 wherein the sum of the matrix output signals is an amplitude weighted sum and the difference of the matrix output signals is an amplitude weighted difference.

42. In a system for coding, transmission, or storage and retrieval of audio signals received from a 4:2 audio signal encoding matrix and applied to a complementary 2:4 audio decoding matrix, the system having a noise level which varies with signal amplitude level, a method comprising determining which of the signals among the encoding matrix output signals and the sum and difference of the encoding matrix output signals has the smallest amplitude, applying the encoding matrix output signals to the coding, transmission, or storage and retrieval if one of the encoding matrix output signals has the smallest amplitude and applying the sum and difference of the encoding matrix output signals to the coding, transmission, or storage and retrieval if one of the sum and difference of the encoding matrix output signals has the smallest amplitude, and also applying a control signal to the coding, transmission, or storage and retrieval indicating if the encoding matrix output signals or the sum and difference of the encoding matrix output signals is being applied to the transmission or storage, and receiving said matrix output signals or the sum and difference of the matrix output signals, and said control signal from the coding, transmission, or storage and retrieval, and recovering unaltered, for use by the complementary 2:4 decoding matrix, the received signals when the matrix encoder output signals are applied to the coding, transmission, or storage and retrieval and recovering the sum and difference of the received signals, for use by the complementary 2:4 decoding matrix, when the sum and difference of the matrix encoder output signals are applied to the coding, transmission, or storage and retrieval.

43. The apparatus of claim 42 wherein the sum of the encoding matrix output signals is an amplitude weighted sum and the difference of the encoding matrix output signals is an amplitude weighted difference.

44. In a system in which the noise level varies with signal amplitude level, a method for adaptively rematrixing signals received from coding, transmission, or storage and retrieval in response to a control signal also received from the coding, transmission, or storage and retrieval for applying the adaptively rematrixed signals to a 2:4 audio decoding matrix, the received signals resulting from encoding by a 4:2 audio signal encoding matrix and adaptive rematrixing of the encoding matrix output signals such that in one state of the adaptive rematrixing the signals applied to the coding, transmission, or storage and retrieval are the output of the encoding matrix and in another state of the adaptive rematrixing the signals applied to the coding, transmission, or storage and retrieval are the sum and difference of the output of the encoding matrix, said control signal indicating the state of the adaptive rematrixing, comprising receiving said matrix output signals or the sum and difference of the matrix output signals from the coding, transmission, or storage and retrieval and producing audio signals representing the output of said 4:2 encoding matrix for application to said 2:4 decoding matrix, recovering unaltered the matrix output signals from the coding, transmission, or storage and retrieval in a first state of operation and recovering the sum and difference of the matrix output signals from the coding, transmission, or storage and retrieval in a second state of operation, and receiving said control signal from said coding, transmission, or storage and retrieval and controlling the state of operation in response thereto such that when the matrix encoder output signals are applied to the coding, transmission, or storage and retrieval, the operation is in the first state and when the sum and difference of the matrix encoder output signals are applied to the coding, transmission, or storage and retrieval, the operation is in the second state.

45. The apparatus of claim 44 wherein the sum of the encoding matrix output signals is an amplitude weighted sum and the difference of the encoding matrix output signals is an amplitude weighted difference.

46. The apparatus of claim 32 wherein the sum of the received signals is an amplitude weighted sum and the difference of the received signals is an amplitude weighted difference.

47. The apparatus of claim 35 wherein the sum of the received signals is an amplitude weighted sum and the difference of the received signals is an amplitude weighted difference.

* * * * *

UNITED STATES PATENT AND TRADEMARK OFFICE

CERTIFICATE OF CORRECTION

PATENT NO. : 5,291,557

DATED : March 1, 1994

INVENTOR(S) : Mark F. Davis, et al

It is certified that error appears in the above-indentified patent and that said Letters Patent is hereby corrected as shown below:

Column 6, line 31 of the patent, "though" should be --through--

Column 15 line 3 of the patent --and-- should be inserted in front of "difference"

Signed and Sealed this

Tenth Day of December, 1996

*Attest:*

*Attesting Officer*

BRUCE LEHMAN

*Commissioner of Patents and Trademarks*